US008888436B2

(12) United States Patent
Donkada et al.

(10) Patent No.: US 8,888,436 B2
(45) Date of Patent: Nov. 18, 2014

(54) SYSTEMS AND METHODS FOR COOLING HIGH PRESSURE AND INTERMEDIATE PRESSURE SECTIONS OF A STEAM TURBINE

(75) Inventors: Santhosh Donkada, Bangalore Karnataka (IN); Howard Brilliant, Schenectady, NY (US); Vishwas Kumar Pandey, Bangalore Karnataka (IN); Debabrata Mukhopadhyay, Bangalore Karnataka (IN)

(73) Assignee: General Electric Company, Schenectady, NY (US)

( * ) Notice: Subject to any disclaimer, the term of this patent is extended or adjusted under 35 U.S.C. 154(b) by 733 days.

(21) Appl. No.: 13/166,967

(22) Filed: Jun. 23, 2011

(65) Prior Publication Data

US 2012/0328409 A1 Dec. 27, 2012

(51) Int. Cl.

| | |
|---|---|
| ***F01D 25/26*** | (2006.01) |
| ***F01D 25/12*** | (2006.01) |
| ***F01D 11/04*** | (2006.01) |

(52) U.S. Cl.

CPC ..... *F01D 25/12* (2013.01); *F01D 11/04* (2013.01); *F05D 2220/31* (2013.01)

USPC ..... 415/1; 415/115

(58) Field of Classification Search

CPC ..... F01D 11/04; F01D 25/12; F05D 2220/31

USPC ..... 415/104, 115–117; 416/97 R

See application file for complete search history.

(56) References Cited

U.S. PATENT DOCUMENTS

| | | | | |
|---|---|---|---|---|
| 3,291,447 | A * | 12/1966 | Brandon | 415/111 |
| 4,150,917 | A | 4/1979 | Silvestri, Jr. | |
| 4,551,063 | A | 11/1985 | Raschke et al. | |
| 6,102,654 | A | 8/2000 | Oeynhausen et al. | |
| 6,382,903 | B1 | 5/2002 | Caruso et al. | |
| 7,101,144 | B2 | 9/2006 | Haje et al. | |
| 7,635,250 | B2 | 12/2009 | Montgomery et al. | |
| 8,251,643 | B2 * | 8/2012 | Zheng et al. | 415/115 |
| 2004/0101395 | A1 | 5/2004 | Tong et al. | |
| 2004/0247433 | A1 | 12/2004 | Haje et al. | |
| 2007/0292258 | A1 | 12/2007 | Kirchhof et al. | |

(Continued)

FOREIGN PATENT DOCUMENTS

| | | |
|---|---|---|
| EP | 0 735 238 | 10/1996 |
| EP | 0 735 254 | 10/1996 |
| EP | 0 735 243 | 12/1996 |
| EP | 1 452 688 | 9/2004 |

(Continued)

OTHER PUBLICATIONS

General Electric, Title: New Cooling Scheme for Combined HP-IP Rotor, Dated Apr. 6, 2011, pp. 1-22.

*Primary Examiner* — Ned Landrum
*Assistant Examiner* — Woody A Lee, Jr.
(74) *Attorney, Agent, or Firm* — Sutherland Asbill & Brennan LLP

(57) ABSTRACT

The present application provides a section cooling system for a steam turbine to limit a leakage flow therethrough. The section cooling system may include a first pressure flow extraction from a first section to a shaft packing location between the first section and a second section and a rotor aperture extending towards the first section. The first pressure flow extraction diverts the leakage flow from the first section into the rotor aperture so as to limit the leakage flow to the second section.

16 Claims, 2 Drawing Sheets

(56) References Cited

U.S. PATENT DOCUMENTS

| | | | | |
|---|---|---|---|---|
| 2008/0213085 | A1* | 9/2008 | Deidewig et al. | 415/104 |
| 2009/0056341 | A1 | 3/2009 | Sanchez et al. | |
| 2009/0185895 | A1* | 7/2009 | Wieghardt | 415/104 |
| 2009/0196735 | A1 | 8/2009 | Bracken et al. | |
| 2010/0008756 | A1* | 1/2010 | Inomata et al. | 415/14 |

FOREIGN PATENT DOCUMENTS

| | | |
|---|---|---|
| EP | 1 892 376 | 8/2006 |
| EP | 1 845 234 | 9/2006 |
| EP | 1 936 115 | 12/2007 |
| EP | 2 143 888 | 1/2010 |

* cited by examiner

SYSTEMS AND METHODS FOR COOLING HIGH PRESSURE AND INTERMEDIATE PRESSURE SECTIONS OF A STEAM TURBINE

TECHNICAL FIELD

The present application and the resultant patent relate generally to turbo-machinery such as steam turbines and the like and more particularly relates to systems and methods for cooling the early stages of high pressure and intermediate pressure sections of a steam turbine and a rotor extending therebetween while limiting leakage flows therein.

BACKGROUND OF THE INVENTION

Steam turbines extract work from a flow of steam to generate power. A typical steam turbine may include a rotor associated with a number of wheels. The wheels may be spaced apart from each other along the length of the rotor and define a series of turbine stages. The turbine stages are designed to extract useful work from the steam traveling on a flow path from an entrance to an exit of the turbine in an efficient manner. As the steam travels along the flow path, the steam causes the wheels to drive the rotor. The steam gradually may expand and the temperature and pressure of the steam gradually may decrease. The steam then may be exhausted from the exit of the turbine for reuse or otherwise. Higher temperature steam turbines may generate increased output as the increased temperature of the steam increases the overall energy available for extraction.

Generally described, a typical steam turbine may include a high pressure section, an intermediate pressure section, and a low pressure section. The sections may be arranged in series with each section including any number of stages. Within the sections, work is extracted from the steam to drive the rotor. Between the sections, the steam may be reheated for performing work in the next section. The high pressure and the intermediate pressure sections may operate at relatively high temperatures so as to increase the overall steam turbine output.

Although most of the flow of steam performs work in the steam turbine by flowing through the stages as described above, a portion of the flow of steam may be lost due to leakage. The steam in the leakage flow does not rotate the rotor or perform useful work. Leakage steam thus represents a loss of rotor torque and overall steam turbine output and efficiency.

Sealing members may be used in the steam turbine to reduce the leakage flow. Overall rotor torque thus may be increased by reducing the amount of the leakage flow. An example of a sealing member is an end packing head. The end packing head may be positioned near end portions of a pressurized section of the steam turbine. For example, one end packing head may be disposed over a portion of the rotor at an upstream side of a first stage bucket. The end packing head may be configured to reduce an amount of steam flowing between the end packing head and the rotor in a direction away from the first stage bucket. A measurable amount of leakage steam, however, still may pass between the rotor and the end packing head.

There is therefore a desire for improved systems and methods for cooling the wheel spaces of high temperature sections and reducing leakage steam, particularly in the case of leakage steam that has not performed useful work. Such improved systems and methods should improve overall system efficiency and output.

SUMMARY OF THE INVENTION

The present application and the resultant patent thus provide a section cooling system for a steam turbine to limit a leakage flow therethrough. The section cooling system may include a first pressure flow extraction from a first section to a shaft packing location between the first section and a second section and a rotor aperture extending towards the first section. The first pressure flow extraction diverts the leakage flow from the first section into the rotor aperture so as to limit the leakage flow to the second section.

The present application and the resultant patent further provide a method of limiting a leakage flow between a high pressure section and an intermediate pressure section of a steam turbine. The method may include the steps of directing a high pressure steam extraction from the high pressure section to a shaft packing location, splitting the high pressure steam extraction into a high pressure flow directed towards the high pressure section and an intermediate pressure flow directed towards the intermediate pressure section, diverting the leakage flow towards the high pressure section with the high pressure flow, and cooling the intermediate pressure section with the intermediate pressure flow therethrough.

The present application and the resultant patent further provide for a section cooling system for a steam turbine to limit a leakage flow therethrough. The section cooling system may include a high pressure flow extraction from a high pressure section to a shaft packing location between the high pressure section and an intermediate pressure section and a rotor aperture extending through a rotor towards the high pressure section. The high pressure flow extraction diverts the leakage flow from the high section into the rotor aperture so as to limit the leakage flow into the intermediate pressure section.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
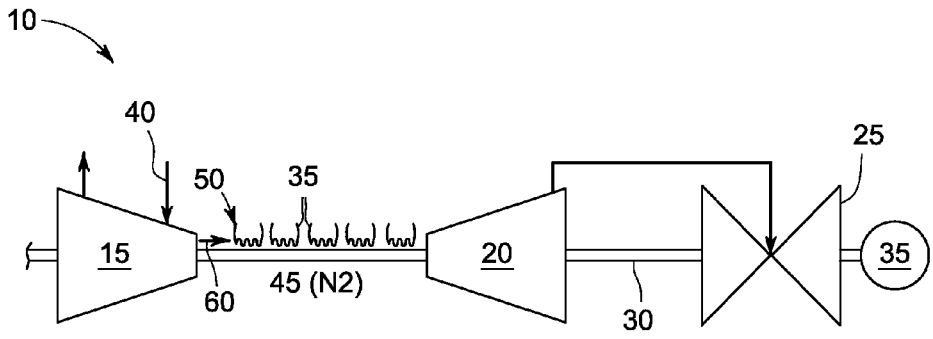
FIG. 1 is a schematic view of a steam turbine.

Referring now to the drawings, in which like numerals refer to like elements throughout the several views, FIG. 1 shows a steam turbine 10 as may be described herein. Generally described, the steam turbine 10 includes a high pressure (HP) section 15, an intermediate pressure (TP) section 20, and a low pressure (LP) section 25. The sections 15, 20, 25 may be positioned on a rotor 30 for rotation therewith. The section 15, 20, 25 may drive the rotor 30 and a load 35 such as an electrical generator and the like. A flow of steam 40 may enter the HP section 15 from a boiler, a steam generator, and the like. The flow of steam 40 may pass through the HP section 15 producing useful work therein and then exit towards a reheater and the like. The flow of steam 40 then may be introduced into the IP section 20 to produce useful work therein. The process then may be repeated for the LP section 25. Other components and other configurations may be used herein.

Figure 2:
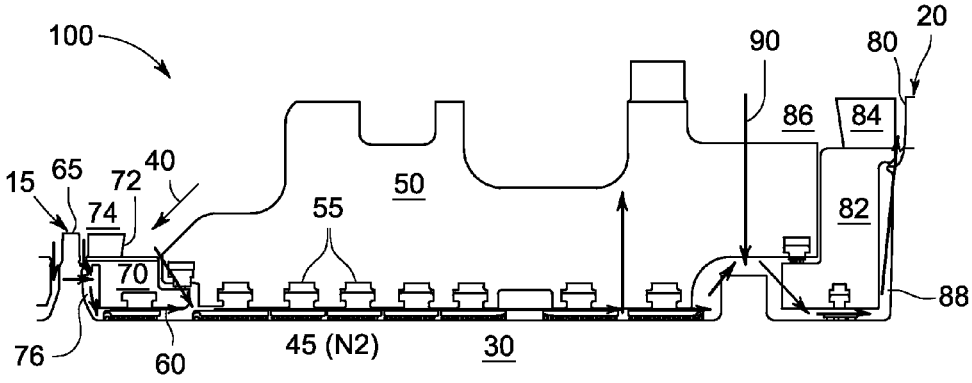
FIG. 2 is a schematic view of a shaft packing location between a high pressure section and an intermediate pressure section of a steam turbine.

FIG. 2 shows a schematic view of a shaft packing location 45. In this example, shaft packing location N2 is shown. This shaft packing location N2 extends between the HP section 15 and the IP section 20 along the rotor 30. An end packing head 50 extends along the rotor 30 with a number of seal members 55 thereon. The seal members 55 may include a number of seal construction types for reducing a leakage flow 60 along the rotor 30. A first stage bucket 65, a diaphragm 70, a partition 72, and portions of a high pressure bowl 74 of the HP section 15 are shown. The first stage bucket 65 has a wheel space 76 adjacent thereto. Likewise, a first stage bucket 80, a diaphragm 82, a partition 84, and portions of an intermediate pressure bowl 86 of the IP section 20 are shown. Other components and other configurations may be used herein. The first stage bucket 80 has a wheel space 88 adjacent thereto In use, the flow of steam 40 enters the HP section 15 about the high pressure bowl 74. A portion of a flow of steam 40 escapes as the leakage flow 60 from the high pressure bowl 74 as well as from upstream and downstream sides of the first stage bucket 65 near the diaphragm 70 and extends along the rotor 30 towards the intermediate pressure section 20. This leakage flow 60 thus may be used to cool the wheel space 88 about the first stage bucket 80 of the IP section 20. This leakage flow 60 may be aided by a high pressure extraction 90 from the HP section 15. This high pressure extraction 90 may be from the sixth stage or other location of the HP section 15. The HP extraction 90 mixes with the leakage flow 60 and cools the leakage flow 60 coming from the high pressure section diaphragm 70 before entering into the first stage bucket 80 of the IP section 20. Other configurations and other components may be used herein.

As described above, the leakage flow 60 may have high enthalpy given that the leakage flow 60 has not performed any useful work with the turbine sections. The leakage flow 60 thus reduces overall steam turbine performance and efficiency. Further, the leakage flow 60 requires additional cooling from the high pressure extraction 90, resulting in a further performance toss, before being used to cool the early stage buckets 80 of the IP section 20.

Figure 3:
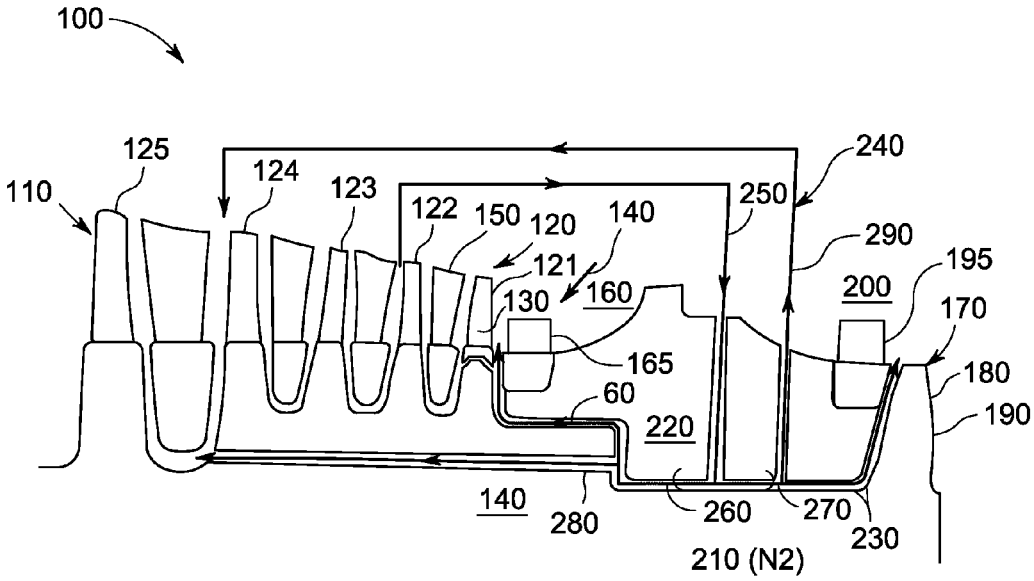
FIG. 3 is a schematic view of a cooling system as may be described herein for use with a shaft packing location between a high pressure section and a low pressure section of a steam turbine.

FIG. 3 shows a portion of a steam turbine 100 as may be described herein. Portions of a high pressure section 110 are shown with a number of high pressure stages 120 therein. Each high pressure stage 120 includes a number of high pressure buckets 130 positioned on a rotor 140 for rotation therewith and a stationary nozzle 150. In this example, five (5) high pressure stages 120 are shown: a first stage 121, a second stage 122, a third stage 123, a fourth stage 124, and a fifth stage 125. Any number of high pressure stages 120, however, may be used herein. The flow of steam 40 enters the RP section 110 by a high pressure bowl 160 about a partition 165 and the bucket 130 of the first high pressure stage 121.

The steam turbine 100 further includes an IP section 170. The IP section 170 also includes a number of intermediate pressure stages 180 with a first stage bucket and wheel 190 shown. Any number of intermediate pressure stages 180 may be used herein. The flow of steam 40 may enter the IP section 170 by an intermediate pressure bowl 200 about the bucket wheel 190 of the first intermediate pressure stage 180 through a first stage partition 195.

The steam turbine 100 also includes a shaft packing location 210 extending between the HP section 110 and the IP section 170. In this example, the shaft packing location N2 is shown. Other shaft packing locations 210 may be used herein. An end packing head 220 may be positioned about the rotor 140. The end packing head 220 includes a number of seal members 230 thereon. Any number and type of seal members 230 may be used herein. The length and configuration of the end packing head 220 may vary herein.

The steam turbine 100 also may include a section cooling system 240. The section cooling system 240 may include a high pressure extraction 250. The high pressure extraction 250 may be taken from about the second stage 122 or any other stage of the HP section 110 based upon temperature and pressure. The high pressure extraction 250 may split into a high pressure flow 260 and an intermediate pressure flow 270. The high pressure flow 260 may block the leakage flow 60 from reaching the IP section 170 coming from the HP section first stage 121. Rather, the leakage flow 60, as well as the high pressure flow 260, may be diverted downstream into the HP section 110 via a rotor aperture 280. The rotor aperture 280 may extend through the rotor 140 or otherwise to any stage 120 of the HP section 110. The rotor aperture 280 may be in communication with, for example, the fourth stage 124 or any other stage 120 of the HP section 110 based upon temperature and pressure. Further, a portion of the intermediate pressure flow 270 may be diverted by an intermediate pressure flow extraction 290. The intermediate pressure flow extraction 290 may be returned to the fifth stage 125 or any other stage 120 within the HP section 110. The remaining intermediate pressure flow 270 may be used to cool the IP stages 180 as described above. Other configurations and other components may be used herein. Dumping the flow through the rotor aperture 280 and the intermediate pressure extraction 290 will improve overall system efficiency and output. The intermediate pressure extraction 290 also may be directed to the intermediate pressure bowl 200 or any intermediate pressure stage 180 of the IP section 170.

The section cooling system 240 described herein thus uses cooler steam from the second stage 122 or any stage 120 of the HP section 110 based upon pressure and temperature as the high pressure extraction 250 into the shaft packing location N2. The use of the HP extraction 250 along with the rotor aperture 280 largely prevents or eliminates the leakage flow 60 from reaching the IP section 170. A resulting performance benefit thus is expected given that the leakage flow 60 is forced back into the HP section 110 so as to produce useful work instead of only being used for cooling. The amount of steam leaking towards the IP section 170 also may be reduced due to the temperature of the steam in the high pressure extraction 250 as opposed to the flow of steam 40 entering the intermediate pressure bowl 200. Increased efficiency thus may be provided herein without sacrificing the cooling efficiency and performance of the IP stages 180 using lower grade rotor materials in the high temperature sections. Lower cost rotor material also may help in bringing down the overall cost of the system. Moreover, higher steam temperatures may be used about the high pressure bowl 160 and the HP section 110 for further performance enhancements and improvements. A reduction in the overall span of the rotor 140 also may be possible. Overall costs likewise will be reduced.

Figure 4:
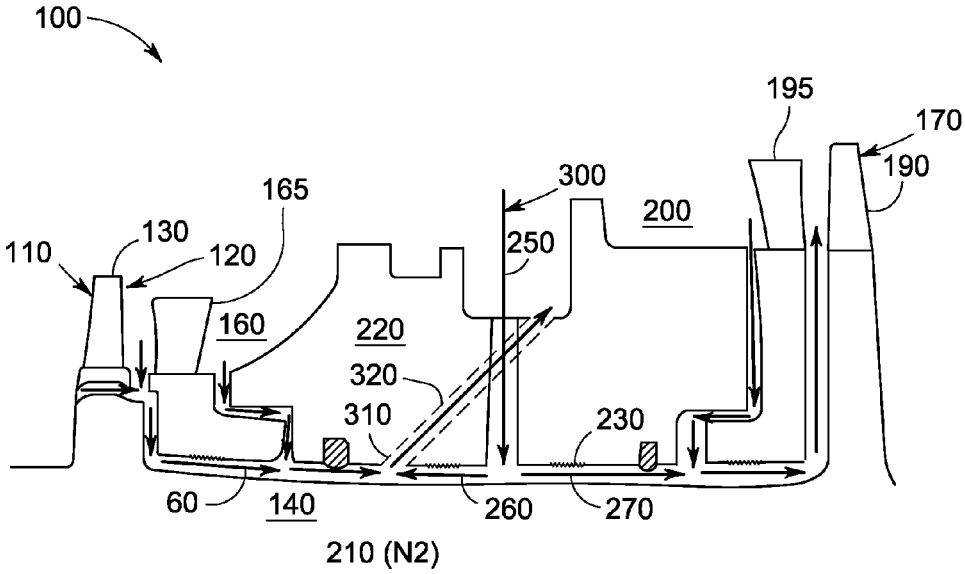
FIG. 4 is a schematic view of an alternative embodiment of a cooling system as may be described herein for use with a shaft packing location between a high pressure section and a low pressure section of a steam turbine.

FIG. 4 shows an alternative embodiment of a section cooling system 300 as may be described herein. Instead of using the rotor aperture 280 through the rotor 140, the section cooling system 300 may include a leakage flow extraction 310 positioned about the end packing head 220 and in the path of the high pressure flow 260 from the high pressure extraction 250. The rotor aperture 280 herein thus may be in the form of a conduit 320 although it is not part of the rotor. The conduit 320 may have any desired size or shape. The high pressure flow 260 forces the leakage flow 60 into the conduit 320 as the leakage flow extraction 310. The leakage flow extraction 310 and the conduit 320 may be in communication with any one of the stages 120 of the HP section 110. The section cooling system 300 thus also may improve overall steam turbine performance and efficiency by limiting the leakage flow 60 into the fP section 170 by achieving the required cooling of the stages of the IP section 170. Other configurations and other components may be used herein.

It should be apparent that the foregoing relates only to certain embodiments of the present application and the resultant patent. Numerous changes and modifications may be made herein by one of ordinary skill in the art without departing front the general spirit and scope of the invention as defined by the following claims and the equivalents thereof.

We claim:

1. A section cooling system for a steam turbine to limit a leakage flow therethrough, comprising:

a first pressure flow extraction from a first section to a shaft packing location between the first section and a second section, wherein the first pressure flow extraction is split into a high pressure flow directed towards the first section and an intermediate pressure flow directed towards the second section, the first section comprises a high pressure section, and the second section comprises an intermediate pressure section; and a rotor aperture extending from the shaft packing location to the first section and from the shaft packing location to the second section;

wherein the first pressure flow extraction diverts the leakage flow from the first section into the rotor aperture so as to limit the leakage flow to the second section.

2. The section cooling system of claim 1, further comprising an intermediate pressure flow extraction of the intermediate pressure flow to the first section.

3. The section cooling system of claim 1, wherein the second section comprises a plurality of stages and a plurality of buckets in communication with the intermediate pressure flow.

4. The section cooling system of claim 1, wherein high pressure flow diverts the leakage flow into the rotor aperture.

5. The section cooling system of claim 1, wherein the rotor aperture extends through the rotor.

6. The section cooling system of claim 5, wherein the rotor aperture extends through the rotor to about a stage of the first section.

7. The section cooling system of claim 1, wherein the rotor aperture extends through a conduit.

8. The section cooling system of claim 7, wherein the conduit extends to a stage of the first section.

9. The section cooling system of claim 1, wherein the shaft packing location comprises an end packing head.

10. The section cooling system of claim 9, wherein the end packing head comprises a plurality of seal members.

11. The section cooling system of claim 1, wherein the first pressure flow extraction extends from a stage of the first section.

12. A method of limiting a leakage flow between a high pressure section and an intermediate pressure section of a steam turbine, comprising:

directing a high pressure steam extraction from the high pressure section to a shaft packing location;

splitting the high pressure steam extraction into a high pressure flow directed towards the high pressure section and an intermediate pressure flow directed towards the intermediate pressure section;

diverting the leakage flow towards the high pressure section with the high pressure flow; and cooling the intermediate pressure section with the intermediate pressure flow.

13. A section cooling system for a steam turbine to limit a leakage flow therethrough, comprising:

a high pressure flow extraction from a high pressure section to a shaft packing location between the high pressure section and an intermediate pressure section, the high pressure flow extraction split into a high pressure flow directed towards the high pressure section and an intermediate pressure flow directed towards the intermediate pressure section; and a rotor aperture extending through a rotor from the shaft packing location to the high pressure section and from the shaft packing location to the intermediate pressure section;

wherein the high pressure flow extraction diverts the leakage flow from the high section into the rotor aperture so as to limit the leakage flow to the intermediate pressure section.

14. The section cooling system of claim 13, further comprising an intermediate pressure flow extraction of the intermediate pressure flow to the high pressure section.

15. The section cooling system of claim 13, wherein the intermediate pressure section comprises a plurality of stages and a plurality of buckets in communication with the intermediate pressure flow.

16. The section cooling system of claim 13, wherein the high pressure flow extraction extends from a stage of the high pressure section.

* * * * *